US009125544B2

(12) United States Patent
Nortrup et al.

(10) Patent No.: US 9,125,544 B2
(45) Date of Patent: Sep. 8, 2015

(54) SURFACE MAINTENANCE VEHICLE WITH COMPACT CLEANING HEAD LIFT MECHANISM AND SUSPENSION

(71) Applicant: Tennant Company, Minneapolis, MN (US)

(72) Inventors: Eric S. Nortrup, Golden Valley, MN (US); Matthew R. Hetler, Crystal, MN (US); Kevin L. Shinler, Minnetonka, MN (US)

(73) Assignee: Tennant Company, Minneapolis, MN (US)

( * ) Notice: Subject to any disclaimer, the term of this patent is extended or adjusted under 35 U.S.C. 154(b) by 98 days.

(21) Appl. No.: 13/767,878

(22) Filed: Feb. 15, 2013

(65) Prior Publication Data

US 2013/0212819 A1 Aug. 22, 2013

Related U.S. Application Data

(60) Provisional application No. 61/599,776, filed on Feb. 16, 2012.

(51) Int. Cl.

| | |
|---|---|
| ***A47L 11/40*** | (2006.01) |
| ***A47L 11/283*** | (2006.01) |
| ***A47L 11/28*** | (2006.01) |
| ***A47L 11/16*** | (2006.01) |

(52) U.S. Cl.

CPC ..... *A47L 11/28* (2013.01); *A47L 11/16* (2013.01); *A47L 11/283* (2013.01); *A47L 11/4055* (2013.01)

(58) Field of Classification Search

USPC ..... 15/49.1, 50.1, 79.2, 87, 320, 340.3, 15/340.4

See application file for complete search history.

(56) References Cited

U.S. PATENT DOCUMENTS

| | | | | | |
|---|---|---|---|---|---|
| 1,452,307 | A | * | 4/1923 | Martin | 15/87 |
| 2,205,671 | A | * | 6/1940 | Sarber | 15/49.1 |
| 2,969,557 | A | * | 1/1961 | Petersen | 15/50.1 |
| 3,204,280 | A | * | 9/1965 | Campbell | 15/314 |
| 3,825,968 | A | * | 7/1974 | Larsen | 15/87 |
| 4,009,500 | A | * | 3/1977 | Ashton | 15/50.1 |
| 4,041,567 | A | * | 8/1977 | Burgoon | 15/320 |
| 4,069,540 | A | * | 1/1978 | Zamboni | 15/320 |
| 4,218,798 | A | * | 8/1980 | Block | 15/49.1 |
| 4,429,433 | A | * | 2/1984 | Burgoon | 15/320 |
| 4,571,771 | A | | 2/1986 | Worwa | |
| 4,674,142 | A | * | 6/1987 | Meili | 15/49.1 |
| 4,731,956 | A | * | 3/1988 | Wood | 451/353 |
| 4,910,824 | A | * | 3/1990 | Nagayama et al. | 15/98 |

(Continued)

FOREIGN PATENT DOCUMENTS

| | | |
|---|---|---|
| EP | 0415563 A1 | 3/1991 |
| EP | 0878163 A1 | 11/1998 |

OTHER PUBLICATIONS

International Search Report for Application No. PCT/US2013/026249, date of mailing Jun. 3, 2013; 13 pages.

*Primary Examiner* — Mark Spisich

(74) *Attorney, Agent, or Firm* — Fredrikson & Byron, P.A.

(57) ABSTRACT

A surface maintenance vehicle with a compact cleaning head lift mechanism and suspension. The cleaning head lift mechanism and suspension adjust a scrub head to an operational mode and a transport mode, yet remain compact such that they are confined to specific areas of the surface maintenance vehicle.

24 Claims, 10 Drawing Sheets

(56) References Cited

U.S. PATENT DOCUMENTS

| | | | | |
|---|---|---|---|---|
| 5,901,407 | A | 5/1999 | Boomgaarden | |
| 5,922,968 | A * | 7/1999 | Briscoe | 73/818 |
| 6,249,926 | B1 * | 6/2001 | Wulff | 15/50.1 |
| 6,493,896 | B1 * | 12/2002 | Stuchlik et al. | 15/49.1 |
| 6,530,102 | B1 * | 3/2003 | Pierce et al. | 15/52.1 |
| 6,618,888 | B2 * | 9/2003 | Joynt et al. | 15/49.1 |
| 6,836,919 | B2 * | 1/2005 | Shinler | 15/78 |
| 2002/0170130 | A1 * | 11/2002 | Shinler | 15/49.1 |
| 2005/0251937 | A1 * | 11/2005 | Ruffo | 15/49.1 |
| 2012/0124760 | A1 * | 5/2012 | Wahl et al. | 15/49.1 |

* cited by examiner

SURFACE MAINTENANCE VEHICLE WITH COMPACT CLEANING HEAD LIFT MECHANISM AND SUSPENSION

PRIORITY CLAIM

The present application claims priority to U.S. Provisional Patent Application Ser. No. 61/599,776 filed Feb. 16, 2012, the disclosure of which is hereby incorporated by reference in its entirety.

FIELD OF THE INVENTION

The present invention generally relates to surface cleaning machines having a cleaning head with a compact lift mechanism and suspension.

BACKGROUND OF THE INVENTION

Floor cleaning in public, commercial, institutional and industrial buildings have led to the development of various specialized floor cleaning machines, such as hard and soft floor cleaning machines. These cleaning machines generally utilize a cleaning head that includes one or more cleaning tools configured to perform the desired cleaning operation on the floor surface. These cleaning machines include dedicated floor sweeping machines, dedicated floor scrubbing machines and combination floor sweeping and scrubbing machines.

An example of a dedicated hard floor sweeping and scrubbing machine is described in U.S. Pat. No. 5,901,407, which is assigned to Tennant Company of Minneapolis, Minn. and which is hereby incorporated by reference in its entirety. The machine uses a cleaning head having two cleaning tools in the form of cylindrical brushes. The cleaning tools counter-rotate in the directions indicated by the arrows shown. Water and detergent are sprayed on the floor ahead of the brushes so the brushes can scour the floor at the same time they are sweeping debris from the floor. A vacuum squeegee removes liquid waste from the floor during the wet scrubbing and sweeping operations. The cleaning tools engage each other such that debris on the floor is swept between the two cleaning tools and is directed into a waste hopper by a deflector.

An example of a dedicated floor sweeper is described in U.S. Pat. No. 4,571,771, which is assigned to Tennant Company of Minneapolis, Minn. and is hereby incorporated by reference in its entirety. The floor sweeper includes a cleaning head comprised of a rotating cylindrical brush that contacts the floor and throws loose debris into a hopper which is periodically emptied either manually or through a motorized lift. Combination floor sweeping and scrubbing machines were developed to avoid the necessity of having two machines. Some floor sweeping and scrubbing machines were created by mounting sweeping components to the front end of a dedicated scrubbing machine to making one large, multi-function machine.

Scrubbing systems are well known in the art. Scrubbing systems commonly include a driver assembly and a cleaning head that is a rotatable scrubber in the form of a brush, pad, or the like. A control device may be utilized for controlling the degree of scrubbing (typically a function of down-force applied through the scrubber) applied to a floor surface depending upon the type and/or condition of floor surface intended to be scrubbed. The scrubber driver assemblies for scrubbing systems are well known in the art and commonly include one or more rotatable brushes driven by a driver motor affixed to a scrubber head. Scrubber heads of the prior art include a lift mechanism that selectively raises and lowers the scrub heads by an actuator coupled to the driver so as to achieve an intended down force or scrubbing pressure of the scrub pad against a floor surface.

Some prior art scrub head lift mechanisms and suspensions have included a large number of parts, which can increase the cost and complexity of such mechanisms and suspensions. In addition, some prior art scrub head lift mechanisms and suspensions have a large footprint on the surface maintenance vehicle that can complicate packaging the scrub head lift mechanisms and suspensions within the confines of the vehicle. In addition, the packaging considerations of a relatively large scrub head lift mechanisms and suspensions make it difficult to use the same scrub head lift mechanisms and suspensions designs on different vehicles of different sizes.

SUMMARY

Certain embodiments of the present invention include a floor surface maintenance machine that has a longitudinally extending frame, wheels connected to the frame, a scrub head, and a lift mechanism and suspension. In certain embodiments the scrub head is connected to the frame and includes a housing and a floor-engaging brush. The scrub head is adjustable to an operational mode and a transport mode. The lift mechanism and suspension includes a linear actuator operable to adjust the scrub head to the operational mode and the transport mode. The lift mechanism and suspension includes a main suspension arm pivotally coupled to the scrub head, a bell crank pivotally coupled to the main suspension arm, the linear actuator pivotally coupled to the bell crank, and a biasing linkage that restricts the pivoting between bell crank and main arm. The restricted pivoting permits the scrub head to rise and fall while passing over any undulations in the floor without requiring engagement of the linear actuator.

Certain embodiments of the present invention include a floor surface maintenance machine that has a longitudinally extending frame, wheels connected to the frame, a scrub head, and a lift mechanism and suspension. The frame defines a lateral width and has a generally planar major top surface. In certain embodiments the scrub head is connected to the frame and includes a housing and a floor-engaging brush. The scrub head is adjustable to an operational mode and a transport mode. The lift mechanism and suspension includes a linear actuator operable to adjust the scrub head to the operational mode and the transport mode. In certain embodiments the entire lift mechanism and suspension is positioned within the lateral width of the frame. In certain embodiments, the entire lift mechanism and suspension is positioned lower than the generally planar major top surface of the frame.

Certain embodiments of the present invention include a floor surface maintenance machine that has a longitudinally extending frame, wheels connected to the frame, a scrub head, and a lift mechanism and suspension. The frame defines a lateral width and has a generally planar major top surface. In certain embodiments the scrub head is connected to the frame and includes a housing and a floor-engaging brush. The scrub head is adjustable to an operational mode and a transport mode. The lift mechanism and suspension includes a linear actuator operable to adjust the scrub head to the operational mode and the transport mode. The linear actuator is adapted to raise the scrub head into the transport position for the transport mode and is adapted to lower the scrub head into an operating position with the floor for the operational mode. A coupling structure connects the scrub head to the frame. The coupling structure provides for movement of the scrub head between the transport position and the operating position. The linear actuator is connected to the coupling structure and to the scrub head.

BRIEF DESCRIPTION OF THE DRAWINGS

The following drawings are illustrative of particular embodiments of the invention and therefore do not limit the scope of the invention. The drawings are not necessarily to scale (unless so stated) and are intended for use in conjunction with the explanations in the following detailed description. Embodiments of the invention will hereinafter be described in conjunction with the appended drawings, wherein like numerals denote like elements.

DETAILED DESCRIPTION

Figure 1A:
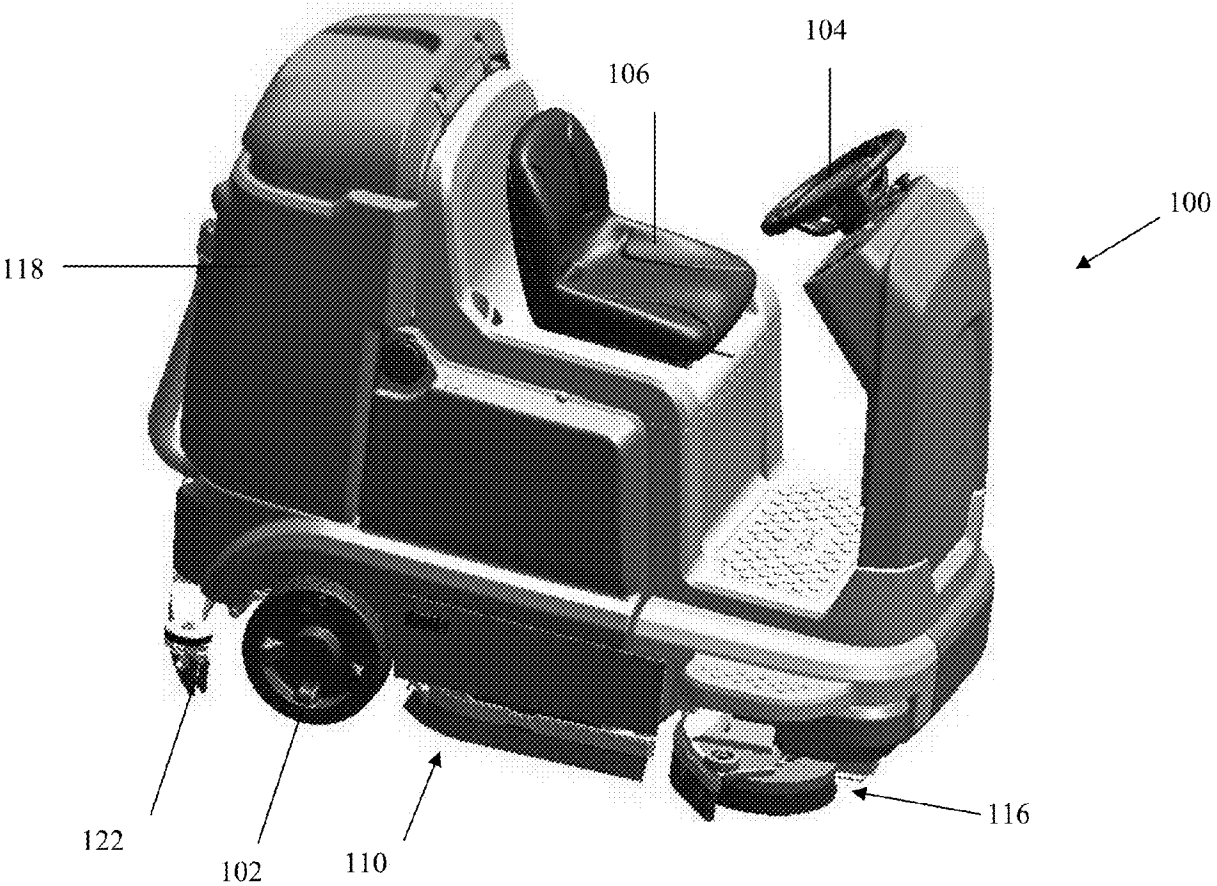
FIG. 1A is an upper perspective view of an exemplary floor surface cleaning machine employing an embodiment of the compact scrub head lift mechanism and suspension of the present invention.
Figure 1B:
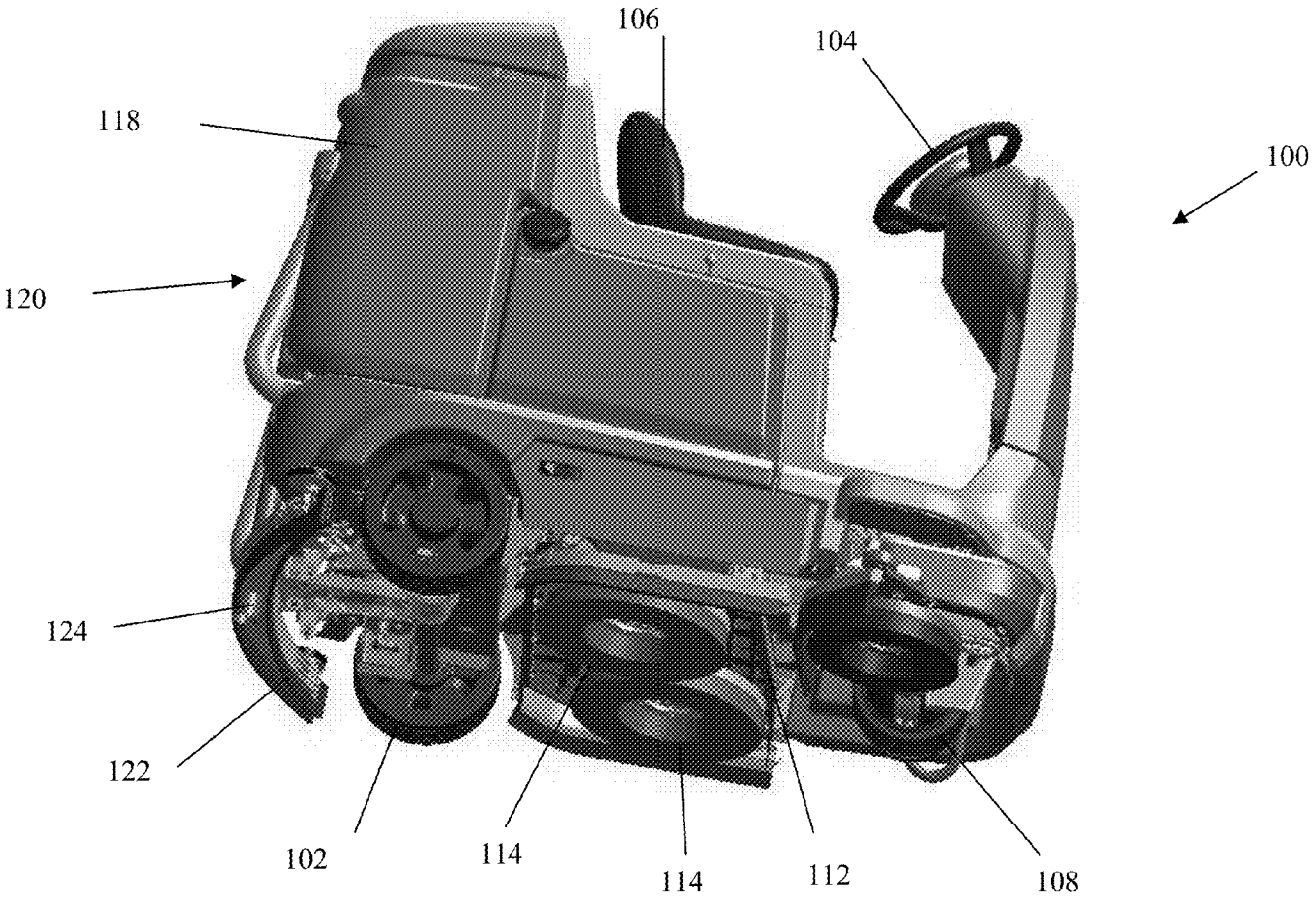
FIG. 1B is a lower perspective view of an exemplary floor surface cleaning machine employing an embodiment of the compact scrub head lift mechanism and suspension of the present invention.

FIGS. 1A-B are upper and lower perspective views, respectively, of an exemplary floor surface cleaning machine 100. Embodiments of the machine 100 include components that are supported on a motorized mobile body. The mobile body comprises a frame supported on wheels 102 for travel over a surface, on which a cleaning operation is to be performed. The mobile body includes operator controls and a steering wheel 104, which is positioned with respect to a seat 106 of machine 100, so that a seated operator of machine 100 may steer a front center wheel 108 of machine 100. Machine 100 is preferably powered by one or more batteries that may be contained in a compartment beneath the seat. Alternately, the power source may be an internal combustion engine, powered through an electrical cord, or one or more power cells, may be employed to power machine 100.

Cleaning components extend from an underside of the machine 100. For example, a scrub head 110 is shown located at a middle portion of machine 100. The scrub head 110 has a housing 112 that encloses two scrub brushes 114. The brushes 114 are driven by two electric motors. An electric actuator attached between the scrub head 110 and the housing 112 raises the scrub head 110 for transport, lowers it for work, and controls its down pressure on the floor. Additional aspects of the electric actuator and associated mechanical coupling are described in more detail hereinafter. The scrub head 110 uses two disk scrub brushes 114 rotating about parallel vertical axes. Alternatively, scrub heads may be made with only one disk scrub brush, or one or more cylindrical brushes rotating about horizontal axes. While a scrub head 110 is depicted in the drawing figures, any appliance or tool for providing surface maintenance, surface conditioning, and/or surface cleaning to a surface may be coupled to an associated machine or vehicle in accordance with the present invention.

Vehicle 100 includes a side brush assembly 116 for cleaning a larger floor envelope. Such side brush assemblies make it easier to clean near walls or other obstacles without damaging the machine or the wall while at the same time widening the cleaning path of the machine to increase productivity. The side brush assembly is mounted on the front, right side of machine 100 and swings outwardly away from the machine center and downwardly toward the surface to be cleaned.

During wet scrubbing operations, water or a cleaning liquid contained in a tank 118 is sprayed to or poured on the surface beneath machine 100, in proximity to the scrub head 110. Brushes 114 scrub the surface and the soiled cleaning liquid is then collected by a fluid recovery system and deposited in a waste recovery tank 120. One embodiment of the fluid recovery system of the machine 100 includes a vacuum squeegee mounted adjacent the rear end of the machine 100. The vacuum squeegee generally comprises a squeegee 122 that extends across the width of the machine 100 and a frame that supports the squeegee 122. The vacuum squeegee also includes a vacuum port 124 that is placed in vacuum communication with a vacuum fan. The vacuum fan operates to remove liquid and particle waste collected by the vacuum squeegee 122 for deposit in the waste recovery tank 120.

In alternate embodiments, the floor surface maintenance machines 100 may be combination sweeper and scrubber machines. In such embodiments, in addition to the elements describe above, the machines 100 may also include sweeping brushes and a hopper extending from the underside of the machine 100, with the sweeping brushes designed to direct dirt and debris into the hopper. In still other embodiments, the machine 100 may be a sweeper only. In such embodiments, the machine 100 may include the elements as described above for a sweeper and scrubber machine, but would not include the scrubbing elements such as scrubbers, squeegees and fluid storage tanks (for detergent, recovered fluid and clean water). Alternatively, the machine 100 may be designed for use by an operator that walks behind the machine, or the machine may be configured to be towed behind a vehicle.

Figure 2A:
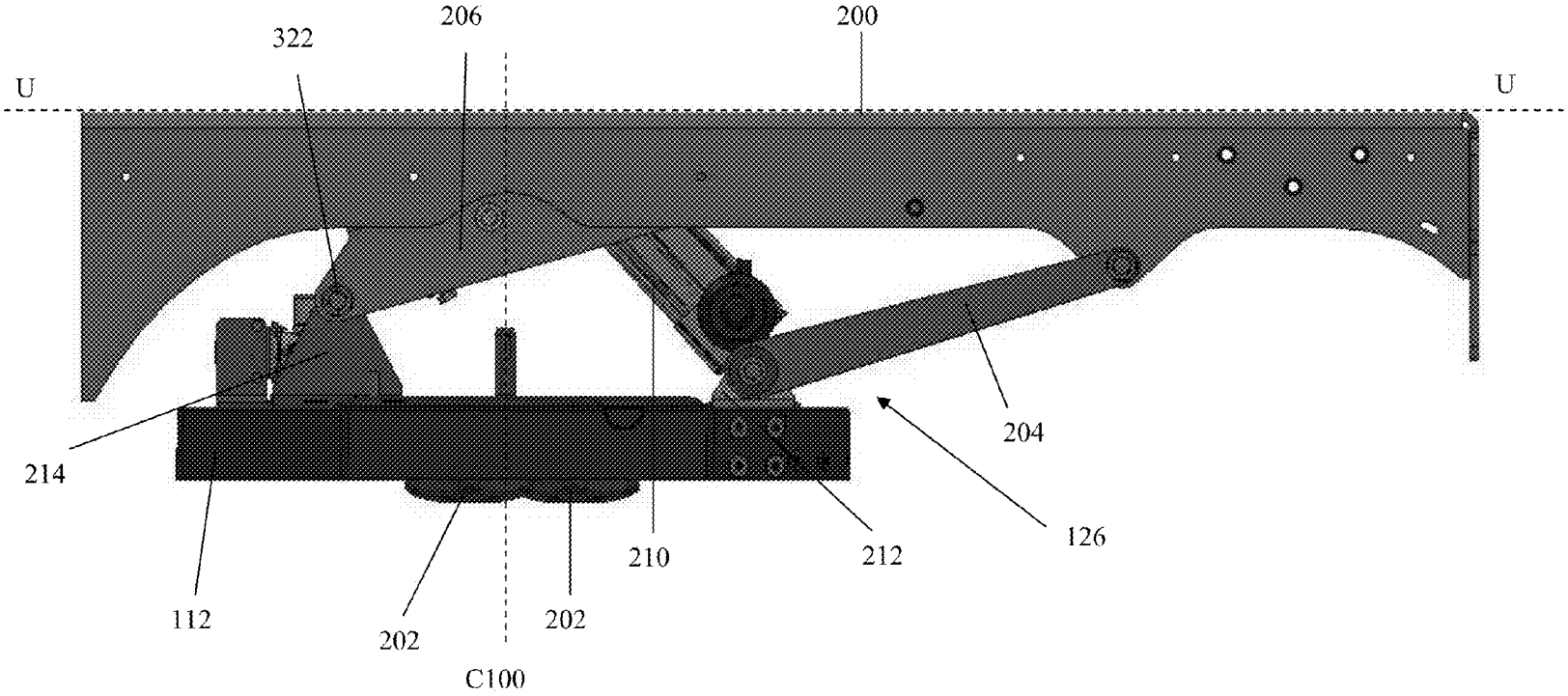
FIG. 2A is a right side elevation view of a frame of the machine of FIG. 1 and a portion of an embodiment of the scrub head and a portion of an embodiment of the compact scrub head lift mechanism and suspension of the present invention.
Figure 3:
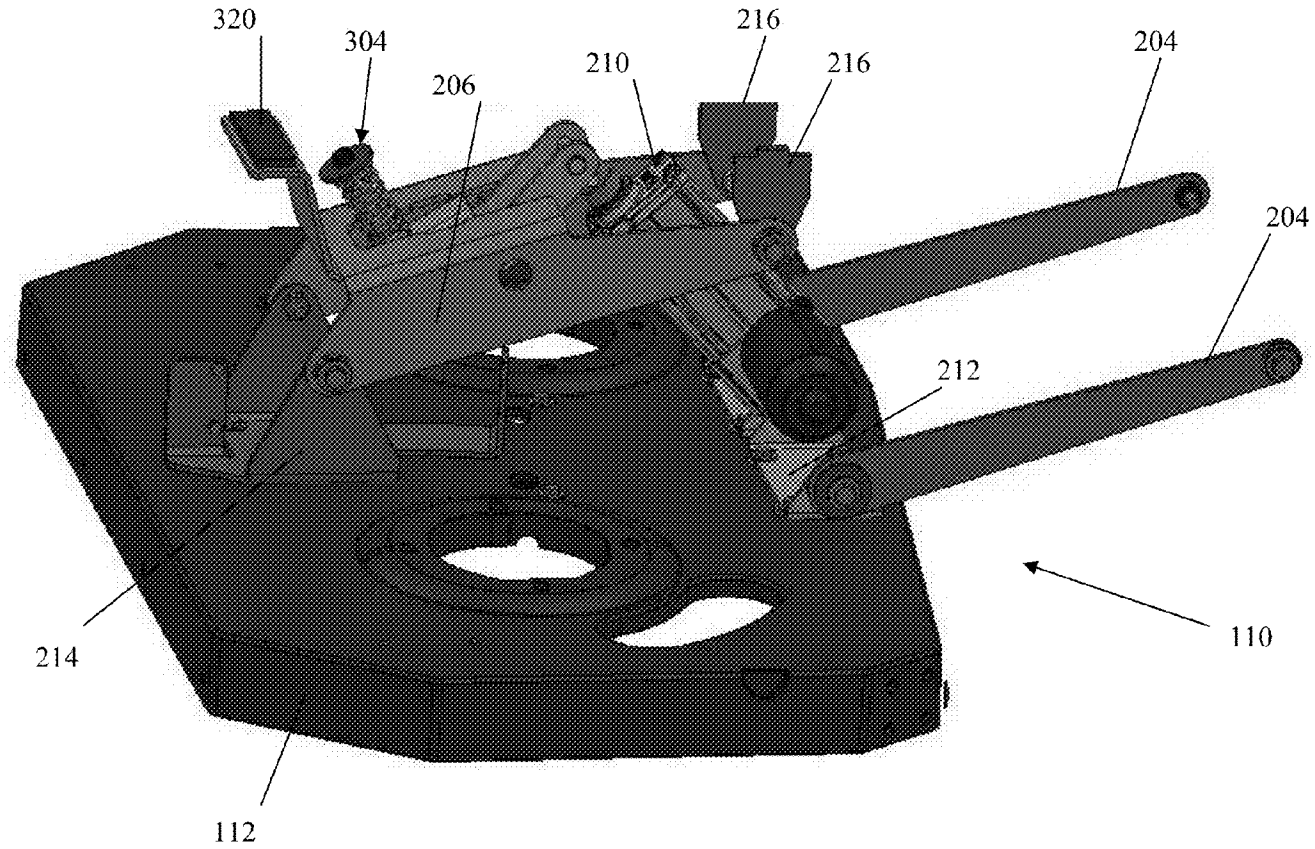
FIG. 3 is a right-side perspective view of a portion of an embodiment of the scrub head and compact scrub head lift mechanism and suspension of the present invention.

FIG. 2A is a right side elevation view of the frame 200 of the machine 100 and a portion of the scrub head 110 and its lift mechanism and suspension. Several components of the scrub head 110, including the brushes 114 and their associated electric motors, have been omitted for clarity. FIG. 3 is a right-side perspective view of a portion of the scrub head 110 and its suspension and lifting mechanism. Several more components of the scrub head have been omitted for clarity. The scrub head 110 includes a housing 112 that encloses and mounts both the scrub brushes and their associated electrical motors. In embodiments employing one or more disk scrub brushes rotating about vertical axes, the housing 112 is a deck. In embodiments employing one or more cylindrical brushes rotating about horizontal axes, the housing 112 is a wrap. Although the brushes 114 are omitted from FIG. 2A, mounts 202 for each scrub brush are shown.

Housing 112 is attached to the frame 200 by a lift mechanism and suspension 126 which allows it to be raised and lowered and allows the brushes 114 to conform to undulations in the floor. The housing 112 is attached to the frame 200 by a lift mechanism and suspension assembly 126 that includes control arms 204, main arm 206, bell crank 208, linear actuator 210, and associated coupling structures. Coupling structures fixedly attached or formed as part of the frame 200 are considered part of frame 200, though. Control arms 204 may also be considered idler arms or drag links. One portion of the coupling structure includes lower brackets 212 of housing 112 for securing a lower end of each control arm 204 to housing 112 with pivoted connections and for securing a lower end of linear actuator 210 to housing 112 with pivoted connections. Another portion of the coupling structure includes rear bracket 214 of housing 112 that is for securing a lower end of main arm 206 to housing 112 with a pivoted connection. Lower brackets 212 and rear bracket 214 are bolted or otherwise fixedly secured to housing 112 via any known methods (bolted, welded, integrally formed, etc.), and thus may be considered part of frame 200. Another portion of the coupling structure includes upper brackets 216 for securing an upper end of each control arm 204 to frame 200 with pivoted connections. Upper brackets 216 are welded to, integral to, or otherwise fixedly secured to frame 200, and thus may be considered part of frame 200.

Frame 200 extends longitudinally and has a cross-section in the shape of an inverted-U. Although other frame elements are bolted, welded, or otherwise connected to frame 200, frame 200 has a major top surface that is generally planar. As shown in FIG. 2A, all the components of the lift mechanism and suspension 126 are positioned at a height lower than the dotted line designated at U, the generally horizontal plane that intersects the major top surface of the frame 200. Accordingly, in certain embodiments, lift mechanism and suspension 126 (e.g., control arms 204, main arm 206, bell crank 208, linear actuator 210) is compact in that it does not extend higher than or protrude through the major top surface of the vehicle frame 200. Past suspension lift mechanisms have protruded up through the frame requiring that other components such as batteries be rearranged or required considerable space on either side of the lift mechanism.

Figure 2B:
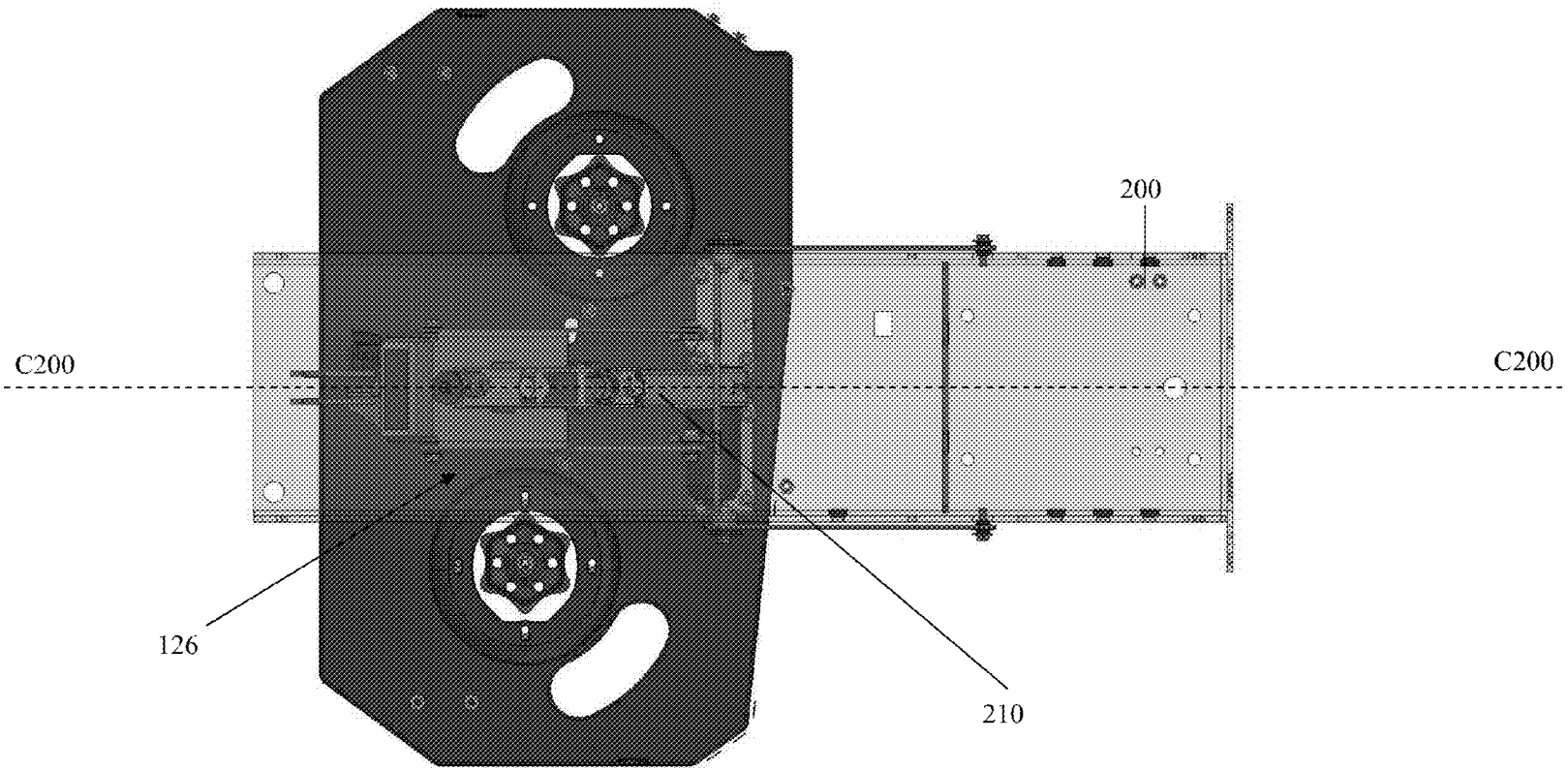
FIG. 2B is a top plan view of the frame and the portion of an embodiment of the scrub head and a portion of an embodiment of the compact scrub head lift mechanism and suspension of FIG. 2A with the frame shown in ghost.

As shown in FIG. 2B, vehicle 100 has a longitudinal centerline shown as a dotted line C200. In many embodiments of the present invention, the leadscrew of linear actuator 210 is located centrally of the vehicle. In the view shown in FIG. 2B, longitudinal centerline C200 runs through the leadscrew of linear actuator 210. In alternate embodiments, the leadscrew is may extend slightly to the right or the left of the longitudinal centerline, such that it is on either side of the longitudinal centerline C200 by less an amount less than 10% of the overall frame width.

Also as shown in FIG. 2B, the components of the lift mechanism and suspension 126 (e.g., control arms 204, main arm 206, bell crank 208, linear actuator 210) remain within the lateral confines of the frame 200. That is, the components of the lift mechanism and suspension 126 do not extend wider than frame 200. Frame 200 is internal and may be considered as a spine frame, but it can be formed in many different manners besides with an inverted U-shape.

Figure 5:
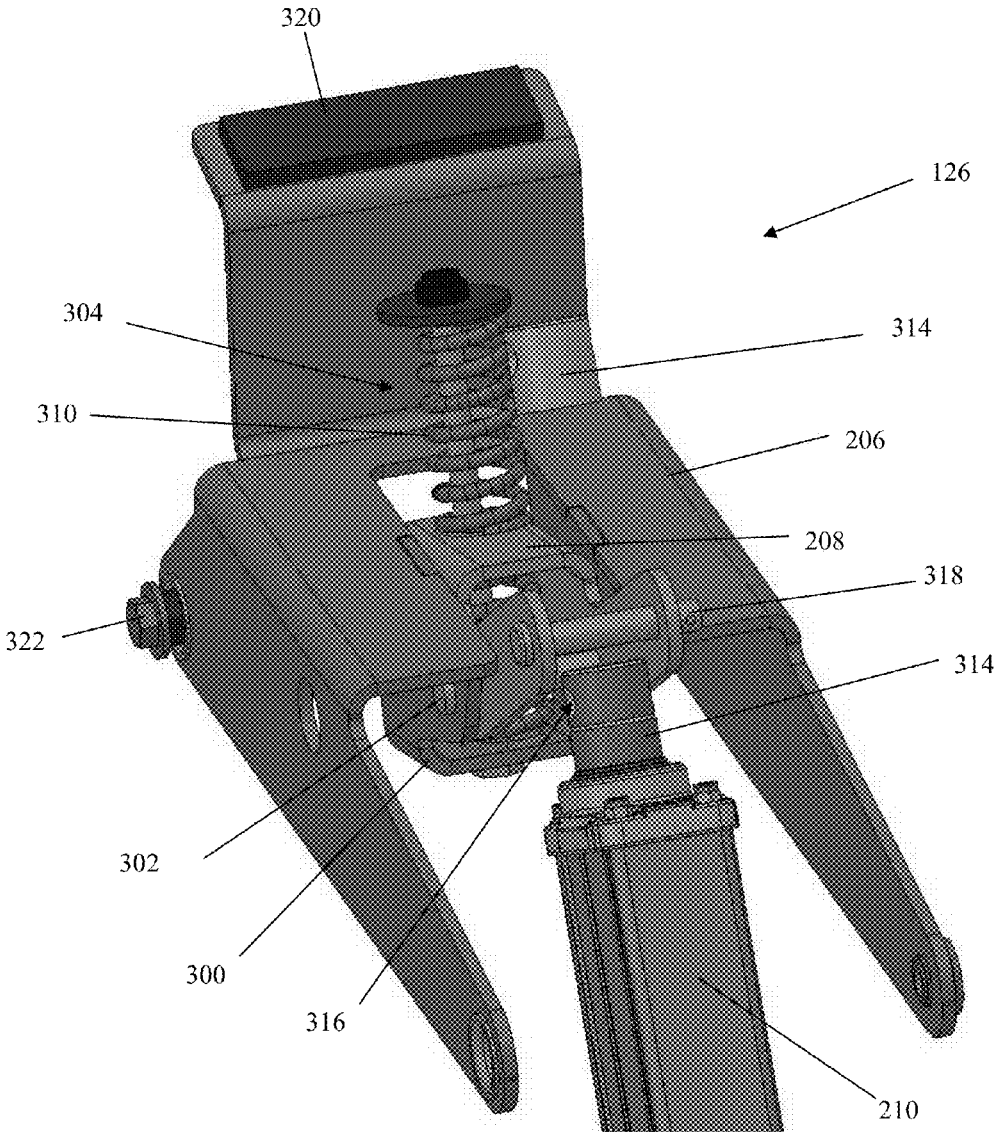
FIG. 5 is an upper right-side perspective view of a portion of an embodiment of the compact scrub head lift mechanism and suspension of the present invention.
Figure 6:
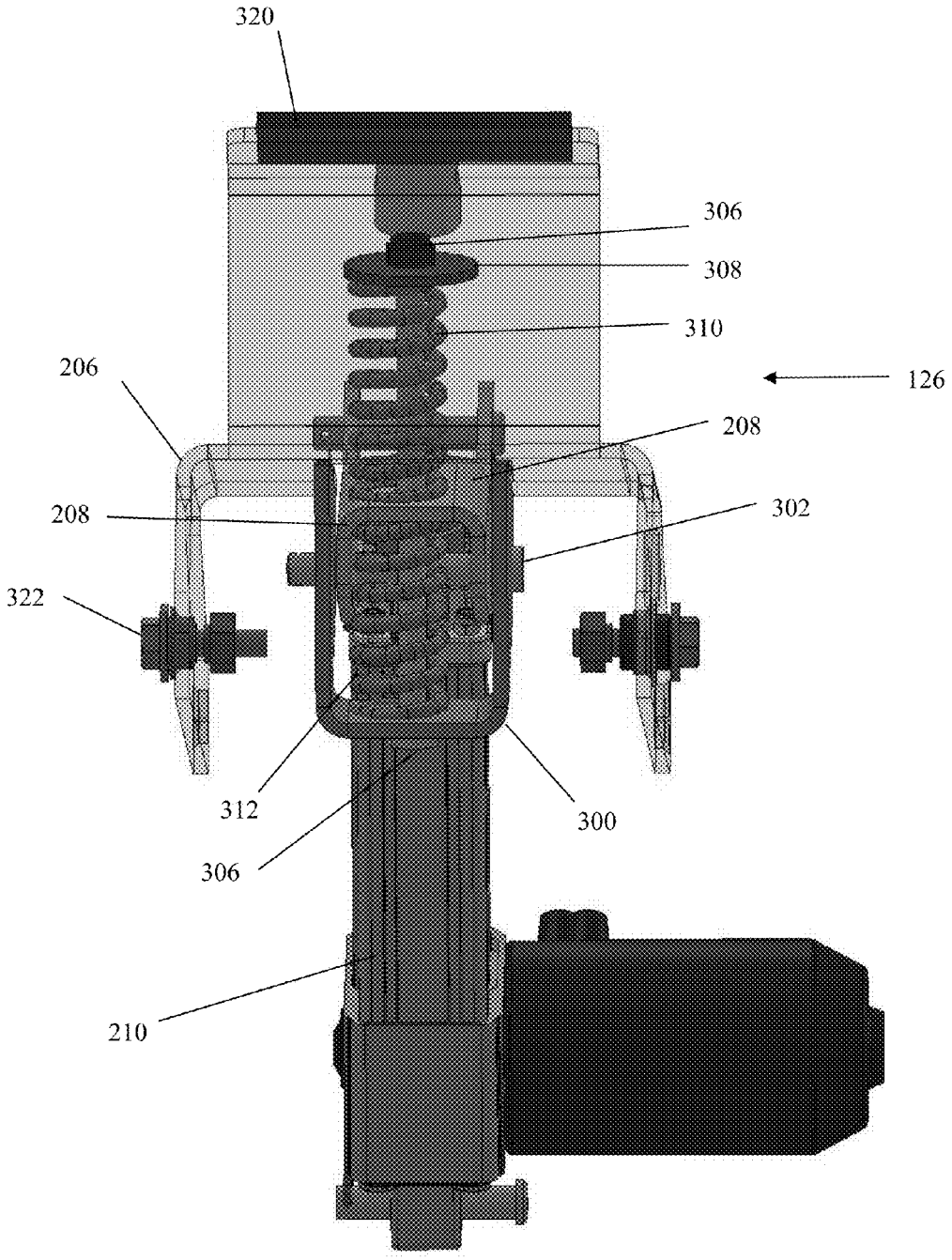
FIG. 6 is a rear elevation view of a portion of an embodiment of the compact scrub head lift mechanism and suspension of the present application with some portions shown in ghost.

FIGS. 5 and 6 illustrate additional aspects of the coupling of main arm 206 to bell crank 208. In FIG. 6, the main arm is shown in ghost for added clarity. Main arm 206 includes a U-shaped bracket 300 that is welded, integral to, or otherwise fixedly secured to an interior slot of main arm 206. Bell crank 208 has an inverted U-shape and is pivotally secured within U-shaped bracket 300 via pin 302. That is, both bell crank 208 and U-shaped bracket 300 have apertures that are aligned to receive pin 302. The pinned connection permits bell crank 208 to pivot relative to U-shaped bracket 300 and, therefore, relative to main arm 206.

The otherwise free pivoting of the bell crank 208 relative to the main arm 206 is restricted by a biasing linkage 304 that includes a bolt 306, washer 308, and an upper spring 310 and a lower spring 312. The biasing linkage 304 provides limited pivoting between bell crank 208 and main arm 206 to permit the housing 112 (and therefore the entire scrub head 110) to rise and fall while passing over any undulations in the floor without requiring engagement of the linear actuator 210. As shown best in FIG. 6, lower spring 312 is a coil spring the ends of which are sandwiched by the interior, central portions of both U-shaped bracket 300 and inverted U shaped bell crank 208. Upper spring 310 is a coil spring, the ends of which are sandwiched between the outer, central portion of inverted U shaped bell crank 208 and washer 308. Bolt 306 extends through both lower spring 312 and upper spring 310 to hold the springs in place and extends through U-shaped bracket 300 and inverted U shaped bell crank 208 through apertures in their central portions. The springs 310, 312 bias the bell crank to pivot to a neutral or default position relative to the main arm 206.

FIG. 5 illustrates additional aspects of the coupling of linear actuator to bell crank 208. Linear actuator 210 is used to raise the housing 112 for transport, lower the housing for work in an operational mode, and control the down pressure of the housing 112 on the floor when in the operational mode. Linear actuator 210 preferably is an electric actuator having a leadscrew member. As in known in the art, leadscrew member has a thread set formed therein and has a distal end 314 which is movable in response to leadscrew rotation. Additional linear actuators may include hydraulic or hybrid electro-hydraulic devices (not shown). The distal end 314 of leadscrew member has a pin-receiving aperture 316 formed therein. A pin 318 is inserted through an aperture in one end of bell crank 208 and also inserted through (although shown without such insertion) the pin-receiving aperture 316 of distal end 314 secures distal end 314 to bell crank 208 with a pivoted connection.

Figure 4:
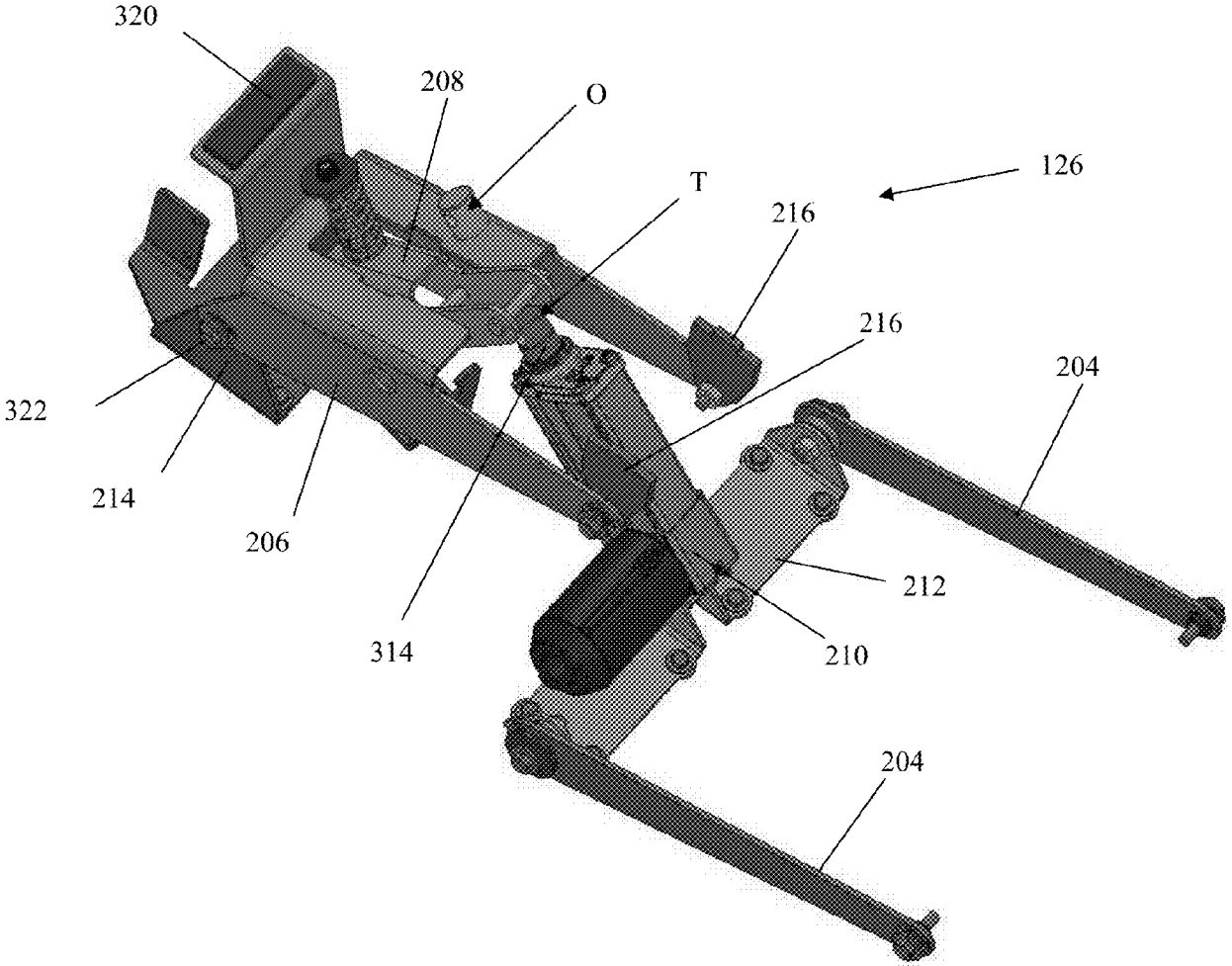
FIG. 4 is an upper right-side perspective view of an embodiment of the compact scrub head lift mechanism and suspension of the present invention.

As noted above, linear actuator 210 is used to raise the housing 112 for transport, lower the housing for work in an operational mode, and control the down pressure of the housing 112 on the floor when in the operational mode. In FIG. 2A, the linear actuator 210 has been actuated to raise the housing 112 upward off of the floor surface for transport. In such a mode, the scrub brushes 114 are also raised off of the floor. Referring to FIG. 4, distal end 314 is shown retracted toward the linear actuator 210 to a position T for transport mode. FIG. 4 also illustrates the distal end 314 extended further away from linear actuator 210 to a position O for the operational mode. It should be noted that while distal end 314 is shown disconnected from linear actuator 210 in position O, this does not happen in reality and is only shown in this manner to illustrate the location of position O relative to position T. As shown in FIGS. 3-6, main arm 206 includes a resilient pad 320 that functions to stop further rotation of main arm 206 about pivot 322. Main arm 206 can rotate until pad 320 abuts the upper wall of frame 200. This may occur when the scrub head is moved to the transport position. Many prior art scrub heads employ an actuator that mounts to the frame of the vehicle. As may be understood from the embodiments discussed above, the actuator 210 mounts between the housing 112 and the bell crank 208 and does not mount to the frame 200. Accordingly, the pivotal connections on both ends of the actuator 210 move up or down as the actuator 210 moves the scrub head between the operational and transport positions. Moreover, as noted above, leadscrew of the actuator 210 is generally centered on the vehicle.

In operation, when in the transport mode, the weight of the scrub head 110 creates a downward force on main link 206, causing it and its U-shaped bracket 300 to rotate relative to the bell crank 208, thereby compressing upper spring 310. As the scrub head is moved into the operational mode, the actuator 210 extends and lowers the housing 112 such that the scrub brushes 114 are lowered onto the underlying floor surface. When the underlying surface supports the weight of the scrub head 110, the main link 206 and its U-shaped bracket 300 rotate relative to bell crank 208 into a neutral position generally centered between upper spring 310 and the lower spring 312 (assuming the springs are equal). As the actuator 210 extends further when moving into the operational mode, scrub head 110 does not compress much further into the underlying floor surface, thus causing bell crank 208 to rotates relative to main link 206 such that lower spring 312 is compressed. The compression of lower spring 312 increases the downforce of the scrub head 110 onto the underlying floor surface beyond just the weight of the scrub head 110.

In scrubbing, if the scrub head 110 encounters undulations in the floor, the biasing linkage 304 permits limited pivoting of the bell crank 208 relative to the main link 206 to permit the scrub head 110 to rise when encountering a high spot and drop and encountering a low spot without having to immediately engage the linear actuator 210. For instance, as scrub head 110 encounters a high spot, the rising housing 112 causes bell crank 208 to pivot in a manner that further compresses lower spring 312. As scrub head encounters a low spot, the weight of scrub head 110 and the already compressed lower spring 312 push scrub head 110 downward to remain flush with the dip in the underlying floor surface. If the dip is low enough, main link 206 and bell crank 208 could rotate relative to each other enough that upper spring 310 could be compressed instead of lower spring 312.

Referring back again to FIG. 2A, main arm 206 connects to rear bracket 214 at pivot point 322. A transverse centerline C100, dividing the front and rear of housing 112 in half is shown in phantom. It may be seen that pivot 322 is located to the rear of transverse centerline C100 of housing 112. In the embodiment shown, pivot 322 is located at about 75 percent of the distance from the front to the rear of housing 112, or halfway between the transverse centerline C100 and the rear of the housing 112. In certain embodiments the pivot 322 is located between 65 and 85 percent of the distance from the front to the rear of housing 112. The down force imparted on housing 112 by main arm 206 at pivot 322 is therefore directed towards the rear half of housing 112. Even though control arms 204 are pivotally connected between frame 200 and housing 112, the control arms 204 are rigid. Thus, the rigidity of control arms 204 helps prevent the downward force from main arm 206 from tilting housing about pivot 322 to an orientation not parallel to the underlying floor. That is, the combination of control arms 204 and the relatively rearward location of pivot 322 maintains the orientation of housing 112 parallel to the floor throughout the travel of the scrub head 110 between its transport position and operational position and when traversing undulations in the floor. By keeping the scrub head 110 parallel to the floor, the rigidity of control arms 204 also helps distribute the non-centrally located downward force from main arm 206 more evenly such that scrub brushes 114 provide a fairly uniform down force or pressure against the underlying floor.

Figure 7:
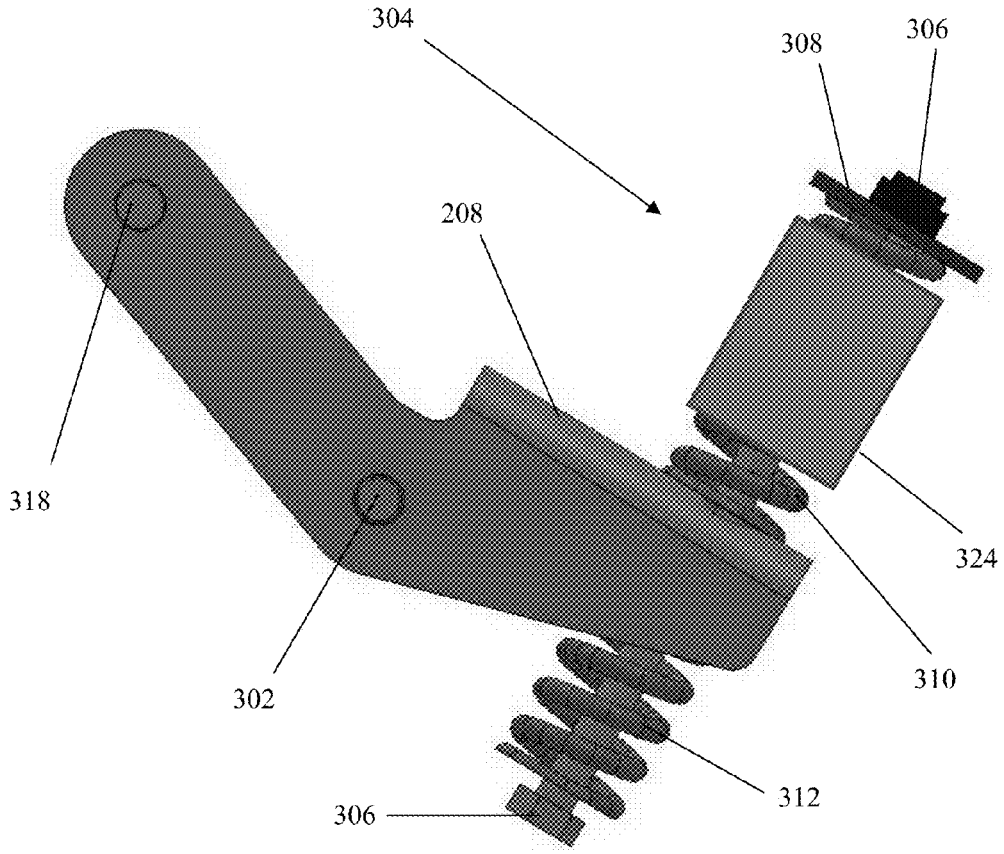
FIG. 7 is a left-side elevation view of a portion of an embodiment of the compact scrub head lift mechanism and suspension of the present application.

FIG. 7 is a left-side elevation view of a portion of an embodiment of the compact scrub head lift mechanism and suspension with some portions shown in ghost. The features (and reference numerals) already described for other drawing figures, also apply to the embodiment of FIG. 7. Similar to the embodiment described above, a pin 318 is inserted through an aperture in one end of bell crank 208 and through the distal end of the leadscrew member to form a pivotal connection. Also, bell crank 208 has an inverted U-shape and is pivotally secured within U-shaped bracket (not shown) via pin 302. The pinned connection at 302 permits bell crank 208 to pivot relative to U-shaped bracket and, therefore, relative to main arm (not shown in FIG. 7).

FIG. 7 shows a modified embodiment of a biasing linkage 304. The biasing linkage 304 restricts the otherwise free pivoting of the bell crank 208 relative to the main arm. Similar to FIGS. 5 and 6, the biasing linkage in FIG. 7 includes a bolt 306, washer 308, and an upper spring 310 and a lower spring 312. Lower spring 312 is a coil spring the ends of which are sandwiched by the interior, central portions of both U-shaped bracket 300 and inverted U shaped bell crank 208. Upper spring 310 is a coil spring, the ends of which are sandwiched between the outer, central portion of inverted U shaped bell crank 208 and washer 308. Bolt 306 extends through both lower spring 312 and upper spring 310 to hold the springs in place and extends through U-shaped bracket 300 and inverted U shaped bell crank 208 through apertures in their central portions. The springs 310, 312 bias the bell crank to pivot to a neutral or default position relative to the main arm 206.

In the embodiment in FIG. 7, the biasing linkage 304 also includes a sleeve 324 that surrounds bolt 306 and upper spring 310 and is also sandwiched between and retained by the outer, central portion of inverted U shaped bell crank 208 and washer 308. Sleeve 324 could be of even smaller diameter such that it is positioned radially between the bolt 306 and the inner, radial surface of upper spring 310. Although sleeve 324 is only shown proximate the upper spring 310, a sleeve 324 could also be employed proximate the lower spring 312. Sleeve 324 functions as an upstop that stops further compression of upper spring 310 when the scrub head is moved to the transport position. That is, when in the transport mode or when moving from the operational mode to the transport mode, the weight of the scrub head 110 creates a downward force on main link, causing it and its U-shaped bracket to rotate relative to the bell crank 208, thereby compressing upper spring 310. In some designs it is desirable to use a relatively elongated upper spring 310 or an upper spring with a relatively low spring constant. In such designs, it may also be desirable to limit the compression of upper spring 310 via the use of sleeve 324 acting as a stop. Sleeve 324 may be made of any material. However, if sleeve 324 is formed of a resilient material, such as plastic or rubber, sleeve 324 also acts as a bumper to help absorb the force of bell crank 208 forcefully compressing upper spring 310.

Figure 8:
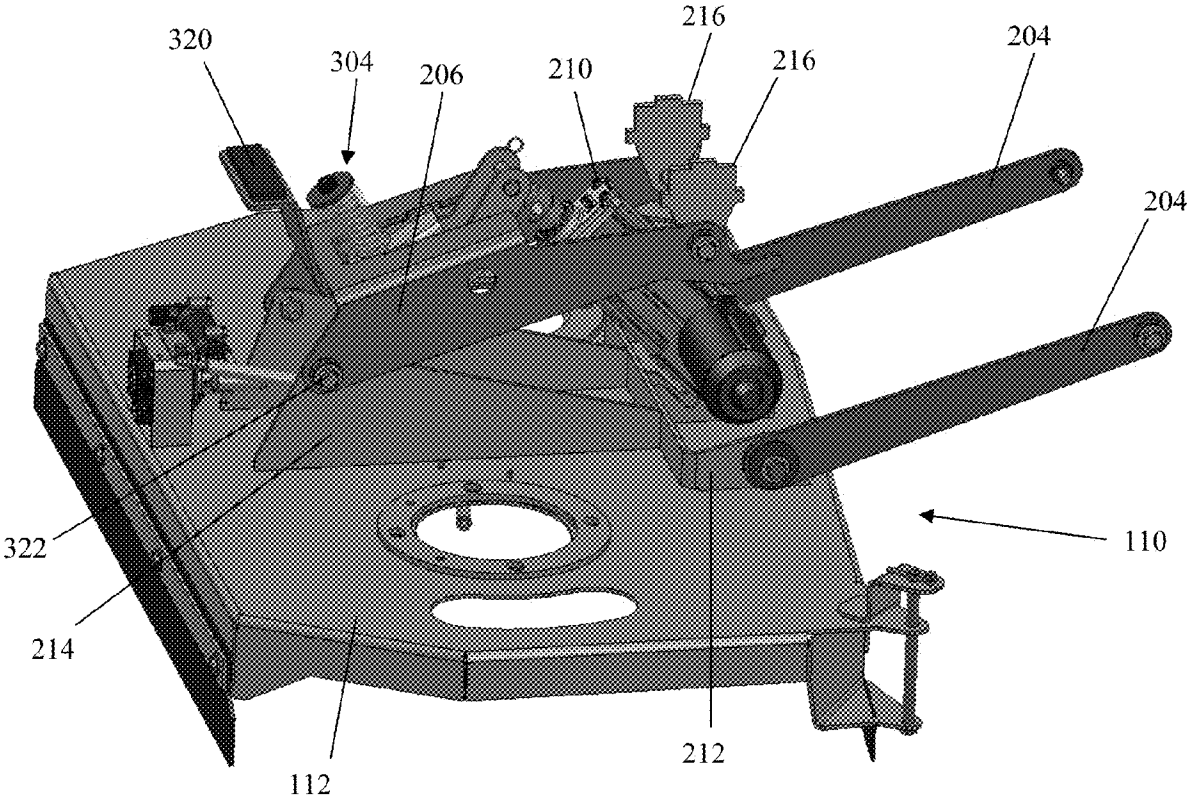
FIG. 8 is a right-side perspective view of a portion of another embodiment of the scrub head and compact scrub head lift mechanism and suspension of the present invention.

Referring to FIG. 8, FIG. 8 is a right-side perspective view of a portion of the scrub head 110 and its suspension and lifting mechanism of an alternative embodiment of the invention, similar to that shown in FIG. 3. As in FIG. 3, several components of the scrub head have been omitted for clarity. The features (and reference numerals) already described for the embodiment in FIG. 3 also apply to the embodiment of FIG. 8. Like numerals denote like elements. In certain embodiments, such as the one shown in FIG. 8, the housing 112 (which is shown as a deck in FIG. 8) is formed of steel. Similar to FIG. 3, lower brackets 212 and rear bracket 214 are bolted or otherwise fixedly secured to housing 112 via any known methods (bolted, welded, integrally formed, etc.), and thus may be considered part of frame 200. However, as shown in FIG. 8, lower brackets 212 and rear bracket 214 are joined together for added strength.

Additional considerations and alternative embodiments with respect to the present invention may include substituting or eliminating certain components and/or subcomponents of the illustrated embodiment. For example, coil springs can be replaced with compliant rubber links or torsion springs, or some other compliant metal link. In addition, alternative pivot join designs may be used, such as spherical bearings, and different bearing styles. Components eliminated (or added) to reduce (or add) adjustability of the position of the scrub head on the machine. To the extent one substitutes a wrap for the scrub deck, cams may be included in the pivot joint between the wrap and the drag links.

Additional advantages and modifications will readily occur to those skilled in the art. The invention in its broader aspects is, therefore, not limited to the specific details, representative apparatus and illustrative examples shown and described. Accordingly, departures from such details may be made without departing from the spirit or scope of the applicant's general inventive concept.

What is claimed is:

1. A floor surface maintenance machine, comprising:

a longitudinally extending frame;

wheels operatively connected to the frame; and a scrub head operatively connected to the frame and adjustable to an operational mode and a transport mode, the scrub head including a housing and a floor-engaging brush carried by the housing; and a lift mechanism and suspension including a linear actuator operable to adjust the scrub head to the operational mode and the transport mode, the lift mechanism and suspension includes a main suspension arm pivotally coupled to the scrub head, a bell crank pivotally coupled to the main suspension arm, the linear actuator pivotally coupled to the bell crank, and a biasing linkage that restricts the pivoting between bell crank and main arm, the restricted pivoting permitting the scrub head to rise and fall while passing over any undulations in the floor without requiring engagement of the linear actuator.

2. The floor surface maintenance machine of claim 1, wherein the biasing linkage includes two or more springs that bias the bell crank to pivot towards a neutral or default position relative to the main arm.

3. The floor surface maintenance machine of claim 2, wherein, when the scrub head is adjusted to the operational mode, the linear actuator causes compression of one of the springs, the compression creating a downforce pushing the scrub head onto the underlying floor surface.

4. The floor surface maintenance machine of claim 2, wherein, the lift mechanism and suspension is configured such that, as scrub head encounters a high spot on the underlying floor surface, the rising scrub head causes bell crank to pivot in a manner that compresses one of the springs.

5. The floor surface maintenance machine of claim 4, wherein, the lift mechanism and suspension is configured such that, as scrub head encounters a low spot on the underlying floor surface, the falling scrub head causes bell crank to pivot in a manner that compresses another one of the springs and permits the one of the springs to expand.

6. The floor surface maintenance machine of claim 1, wherein the biasing linkage includes a bolt that extends through an upper spring and a lower spring and through the bell crank to hold the springs in place on opposite sides of the bell crank, the springs biasing the bell crank, in opposing directions, to pivot towards a neutral or default position relative to the main arm.

7. The floor surface maintenance machine of claim 6, wherein, when moved to the operational mode, the linear actuator causes compression of one of the springs, the compression creating a downforce pushing the scrub head onto the underlying floor surface.

8. The floor surface maintenance machine of claim 6, wherein, the biasing linkage includes a sleeve at least partially co-extensive with one of the springs, the bolt extending through the sleeve, the sleeve forming a pivot stop that stops further compression of the one of the springs by the bell crank to limit further pivoting of the bell crank relative to the main arm.

9. A floor surface maintenance machine, comprising:

a longitudinally extending frame defining a lateral width and having a generally planar major top surface;

wheels operatively connected to the frame; and a scrub head operatively connected to the frame and adjustable to an operational mode and a transport mode, the scrub head including a housing and a floor-engaging brush carried by the housing; and a lift mechanism and suspension, including a linear actuator, a main suspension arm and a biasing linkage, operable to adjust the scrub head to the operational mode and the transport mode, the linear actuator, the main suspension arm and the biasing linkage each being positioned below the generally planar major top surface of the frame, the main suspension arm connected to a first end of the linear actuator via the biasing linkage and a second end of the linear actuator being coupled to the housing, wherein the housing includes a bracket that pivotally connects to the main suspension arm of the lift mechanism and suspension, the pivotal connection being located to the rear of a transverse centerline of the housing.

10. The floor surface maintenance machine of claim 9, wherein the lift mechanism and suspension includes control arms coupled to the frame and the scrub head, and a bell crank coupled to the main suspension arm.

11. The floor surface maintenance machine of claim 9, wherein the housing is a brush deck or a wrap.

12. The floor surface maintenance machine of claim 9, wherein the lift mechanism and suspension includes rigid control arms pivotally connected between the frame and the housing.

13. The floor surface maintenance machine of claim 12, wherein the housing is oriented generally parallel to the underlying floor, the rigid control arms and the suspension arm having pivotal connections to the housing that permit the housing to rise and fall when the scrub head encounters undulations in the underlying floor yet maintain the generally parallel orientation as the housing rises and falls.

14. The floor surface maintenance machine of claim 9, wherein the biasing linkage is positioned between opposing first and second ends of the main suspension arm.

15. The floor surface maintenance machine of claim 14, wherein the linear actuator is pivotally connected to the scrub head, the pivotal connection between the scrub head and the linear actuator is opposite to the connection between the linear actuator and the biasing linkage.

16. The floor surface maintenance machine of claim 15, wherein the pivotal connection between the linear actuator and the scrub head is positioned to the front of the transverse centerline of the housing.

17. The floor surface maintenance machine of claim 16, wherein the connection between the linear actuator and the biasing linkage is proximal to the transverse centerline of the housing, and the pivotal connection between the linear actuator and the scrub head is distal to the transverse centerline of the housing.

18. The floor surface maintenance machine of claim 14, wherein the first end of the main suspension arm is connected to the frame, and the second end of the main suspension arm is connected to the scrub head, the connections of the first and second ends of the main suspension arm being positioned on opposite sides of the transverse centerline of the housing.

19. A floor surface maintenance machine, comprising:

a longitudinally extending frame;

wheels operatively connected to the frame;

a scrub head operatively connected to the frame and adjustable to an operational mode and a transport mode, the scrub head including a housing and a floor-engaging brush carried by the housing; and a lift mechanism and suspension, including a linear actuator pivotally coupled to the lift mechanism and suspension without being connected to the frame of the floor surface maintenance machine, the linear actuator being operable to adjust the scrub head to the operational mode and the transport mode, the linear actuator being adapted to raise the scrub head into a transport position for the transport mode and adapted to lower the scrub head into an operating position in contact with the floor for the operational mode, the lift mechanism and suspension including a main suspension arm pivotally coupled to the scrub head, the linear actuator having opposing first and second ends, the first end being coupled to the the scrub head and the second end being coupled to the main suspension arm via a biasing mechanism such that actuation of the linear actuator pivots the main suspension arm, the biasing mechanism providing restricted pivotal movement of the main suspension arm, the restricted pivotal movement of the main suspension arm permitting the scrub head to rise and fall while passing over any undulations in the floor without actuating the linear actuator; and an arm connecting the scrub head to the frame, the arm guiding the movement of the scrub head between the transport position and the operating position.

20. The floor surface maintenance machine of claim 19, wherein, the first end of the linear actuator having a pivotal connection to the scrub head, the second end of the linear actuator having a pivotal connection to the biasing mechanism.

21. The floor surface maintenance machine of claim 20, wherein the first pivotal connection moves up and down with the scrub head as the scrub head moves up and down between the transport position and the operating position.

22. The floor surface maintenance machine of claim 20, wherein the second pivotal connection moves up or down relative to the frame as the scrub head moves between the transport position and the operating position.

23. The floor surface maintenance machine of claim 19, wherein the linear actuator includes a leadscrew and the frame defines a longitudinal centerline, the leadscrew generally extending along the longitudinal centerline of the frame.

24. The floor surface maintenance machine of claim 23, wherein the leadscrew generally extends along the longitudinal centerline of the frame such that it is on either side of the longitudinal centerline within 10% of the overall frame width.

* * * * *